US010119203B2

(12) United States Patent
Hino et al.

(10) Patent No.: US 10,119,203 B2
(45) Date of Patent: Nov. 6, 2018

(54) GLOSSY MEMBER AND METHOD OF PRODUCING THE MEMBER

(71) Applicant: CANON KABUSHIKI KAISHA, Tokyo (JP)

(72) Inventors: Tetsuo Hino, Yamato (JP); Kenji Takashima, Numazu (JP); Kazuhiro Yamauchi, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 186 days.

(21) Appl. No.: 15/006,334

(22) Filed: Jan. 26, 2016

(65) Prior Publication Data

US 2016/0222546 A1 Aug. 4, 2016

(30) Foreign Application Priority Data

Feb. 2, 2015 (JP) ..... 2015-018344

(51) Int. Cl.
*D01D 5/00* (2006.01)
*D01F 6/16* (2006.01)

(52) U.S. Cl.
CPC ..... *D01D 5/0084* (2013.01); *D01D 5/003* (2013.01); *D01D 5/0092* (2013.01); *D10B 2321/08* (2013.01); *D10B 2401/20* (2013.01)

(58) Field of Classification Search
CPC .. D01F 6/46; D01F 6/92; D01D 5/003; D01D 5/0084; D01D 5/0092; D01B 2321/08; D01B 2321/20

(Continued)

(56) References Cited

U.S. PATENT DOCUMENTS

2010/0003877 A1* 1/2010 Fan ..... B32B 5/022 442/132
2014/0231332 A1* 8/2014 Hirozawa ..... B01D 63/10 210/321.83

(Continued)

FOREIGN PATENT DOCUMENTS

JP 2009-102778 A 5/2009

OTHER PUBLICATIONS

Solubility parameters, Big Chemical Encyclopedia, accessed online Dec. 5, 2017.*

(Continued)

*Primary Examiner* — Camie S Thompson
(74) *Attorney, Agent, or Firm* — Fitzpatrick, Cella, Harper & Scinto

(57) ABSTRACT

Provided is a glossy member, including: a polymer substrate; and a polymer fiber assembly disposed on the polymer substrate, in which: the polymer fiber assembly has polymer fibers oriented in a given direction; an absolute value of a difference between an average solubility parameter of a constituent material for the polymer substrate and an average solubility parameter of a polymer material of the polymer fibers is less than 5 $(J/cm^3)^{1/2}$; the polymer fibers have an orientation degree of 90% or more; the polymer fibers have fiber diameters of 0.05 μm or more and 5 μm or less; and in at least part of a repeating unit structure in the polymer material, a dipole moment is 0 D or more and 3.50 D or less, and an absolute value of a SOMO is 9 eV or more and 12 eV or less.

8 Claims, 2 Drawing Sheets

(58) Field of Classification Search
USPC ..... 428/297.4, 299.1, 297.7
See application file for complete search history.

(56) References Cited

U.S. PATENT DOCUMENTS

| | | | |
|---|---|---|---|
| 2015/0093517 | A1 | 4/2015 | Muranaka et al. |
| 2015/0218324 | A1 | 8/2015 | Hino et al. |
| 2015/0273366 | A1 | 10/2015 | Takashima et al. |
| 2015/0273377 | A1 | 10/2015 | Takashima et al. |
| 2015/0273812 | A1 | 10/2015 | Takashima et al. |

OTHER PUBLICATIONS

Takashima et al., U.S. Appl. No. 14/837,886, filed Aug. 27, 2015.
Yasufuku et al., U.S. Appl. No. 14/879,227, filed Oct. 9, 2015.

* cited by examiner

GLOSSY MEMBER AND METHOD OF PRODUCING THE MEMBER

BACKGROUND OF THE INVENTION

Field of the Invention

The present invention relates to a glossy member and a method of producing the member.

Description of the Related Art

In recent years, a metallic glossy film formed of an organic material has been attracting attention because a metallic gloss can be obtained even when no metal is used.

Japanese Patent Application Laid-Open No. 2009-102778 discloses a method of producing an ultrafine fiber assembly (nanofiber film) formed of an organic material and having a metallic gloss. Disclosed in the above-mentioned literature is a method of producing a metallic glossy fiber assembly (nanofiber film having a metallic gloss) through the use of an electrospinning method serving as a method of producing a nanofiber through the use of a high voltage. In addition, according to the above-mentioned literature, the metallic glossy fiber assembly is produced by assembling, on the surface of a rotating collector, ultrafine fibers arrayed in one direction through the use of at least one of the following units (a) to (c) so that an assembly to be obtained may have a predetermined width and a predetermined thickness:

(a) a static eliminating unit configured to irradiate an ultrafine fiber (nanofiber) to be linearly wound onto the rotating collector with an antistatic ion to neutralize the charge of the ultrafine fiber when a high voltage is applied between a solution-leaving site serving as a site where a fiber is drawn from a solution prepared by dissolving an ultrafine fiber raw material in a solvent and the rotating collector, and the charged solution is sucked and injected from the solution-leaving site toward the rotating collector;

(b) an electric field-controlling unit configured to control the electric field of a spinning space ranging from the solution-leaving site to the rotating collector; and (c) an airflow-controlling unit configured to suppress the disturbance of the orbit of a spinning jet by an airflow on the surface of the rotating collector produced by the rotation of the rotating collector.

SUMMARY OF THE INVENTION

The present invention is directed to providing a glossy member that can be produced without the use of any large-scale apparatus and has satisfactory durability, and a method of producing the member.

A glossy member according to one aspect of the present invention includes:

a polymer substrate; and a polymer fiber assembly disposed on the polymer substrate, in which:

the polymer fiber assembly has polymer fibers oriented in a given direction;

an absolute value of a difference between an average solubility parameter of a constituent material for the polymer substrate and an average solubility parameter of a polymer material of the polymer fibers is less than 5 $(J/cm^3)^{1/2}$;

the polymer fibers have an orientation degree of 90% or more;

the polymer fibers have fiber diameters of 0.05 μm or more and 5 μm or less; and in at least part of a repeating unit structure in the polymer material, a dipole moment is 0 D or more and 3.50 D or less, and an absolute value of a SOMO is 9 eV or more and 12 eV or less.

In addition, a method of producing a glossy member according to another aspect of the present invention is a method of producing a glossy member including a polymer fiber assembly through use of an electrospinning method, the method including:

a spinning step of ejecting a polymer solution from a solution-leaving site while controlling an electric field of a spinning space ranging from the solution-leaving site to a collector; and an orienting step of winding polymer fibers produced by the spinning step around the collector to orient the polymer fibers, the collector including a polymer substrate, in the spinning step, the controlling an electric field of a spinning space being performed by a plurality of electrodes placed to be spaced apart from the collector and to sandwich the collector therebetween, in the spinning step, a voltage opposite to a voltage to be applied to the solution-leaving site is alternately applied to each of the electrodes at a switching speed of 1 second or less.

According to the present invention, the glossy member that can be produced without the use of any large-scale apparatus and has satisfactory durability, and the method of producing the member can be provided.

Further features of the present invention will become apparent from the following description of exemplary embodiments with reference to the attached drawings.

DESCRIPTION OF THE EMBODIMENTS

Figure 1A:
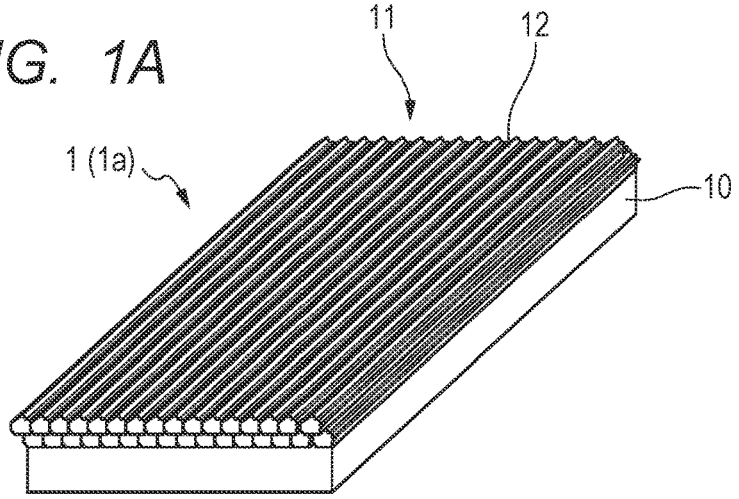
FIGS. 1A and 1B are schematic views for illustrating examples of a glossy member according to an embodiment of the present invention.

Preferred embodiments of the present invention will now be described in detail in accordance with the accompanying drawings.

[Glossy Member]

A glossy member of the present invention is described below. The glossy member of the present invention includes: a polymer substrate; and a polymer fiber assembly disposed on the polymer substrate. In the present invention, the polymer fiber assembly has polymer fibers oriented in a given direction. In the present invention, an absolute value of a difference between an average solubility parameter of a constituent material for the polymer substrate and an average solubility parameter of a polymer material of the polymer fibers is less than 5 $(J/cm^3)^{1/2}$. In the present invention, the polymer fibers have an orientation degree of 90% or more. In the present invention, the polymer fibers have fiber diameters of 0.05 μm or more and 5 μm or less. In the present invention, in at least part of a repeating unit structure in the polymer material, a dipole moment is 0 D or more and 3.50 D or less, and an absolute value of a SOMO is 9 eV or more and 12 eV or less.

As described above, the glossy member of the present invention includes the polymer substrate and the polymer fiber assembly having a metallic gloss to be disposed on the polymer substrate. In addition, the polymer fiber assembly in the glossy member of the present invention has the polymer fibers oriented in the same direction (identical direction) at a high orientation degree. It is to be noted that in the present invention, the polymer fibers are sometimes referred to as "nanofibers" because of the sizes of their fiber diameters. In addition, the polymer fiber assembly is sometimes referred to as "nanofiber film" because the film is formed of the nanofibers.

In the present invention, ultrafine fibers formed of a polymer material are used as the polymer fibers in the polymer fiber assembly having a metallic gloss.

The polymer fiber assembly having a metallic gloss is a film that can express a metallic gloss without the use of any metal. The assembly can express an external appearance having a gloss like a metal without the use of any painting or plating while the assembly is free of any heavy metal and hence reduced in environmental burden, and is lightweight. Accordingly, the assembly can be used as, for example, a decorative layer by being applied to the surfaces of various members (such as a housing and an axial body). Needless to say, for example, the polymer fiber assembly may be directly formed on the substrate or on the outer peripheral surface thereof, or may be formed on any other layer, such as an adhesion layer, after the other layer has been formed on the substrate. It is to be noted that in the present invention, a layer formed of a pressure-sensitive adhesive may be disposed on the surface of the substrate, or the surface may be subjected to a tackifying treatment.

In the present invention, the term "metallic gloss" refers to a gloss approximate to glosses peculiar to metals (metal glosses), and more specifically, means the property by which light is reflected, the property being observed in a smooth surface. In other words, as long as the surface of the polymer fiber assembly is smooth, even the nonmetallic polymer fibers to be used in the present invention can express a gloss substantially the same as the glosses peculiar to the metals.

In the present invention, specific examples of the metal glosses include a silver gloss emitted from aluminum, silver, or the like, and a honey-color gloss (golden gloss) emitted from gold or the like. In addition, in the present invention, a chromatic-color metal gloss called a metallic red, a metallic blue, a metallic yellow, or the like is also included in the metal glosses. In addition, a metallic glossy color is, for example, a silver color, but is not limited thereto, and a chromatic color having a gloss is of course included in such color. The term "chromatic color" as used herein refers to, for example, a blue color, a yellow color, a green color, a purple color, or a red color.

Figure 1B:
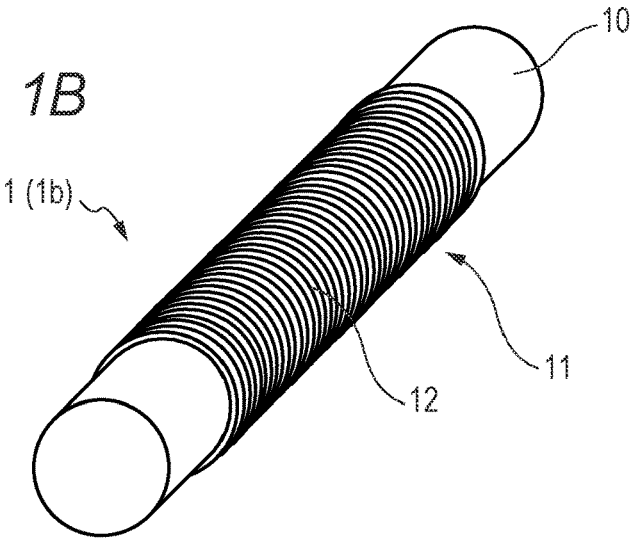

The glossy member of the present invention is described below with reference to the drawings. FIG. 1A and FIG. 1B are schematic views for illustrating examples of a glossy member according to an embodiment of the present invention. It is to be noted that a glossy member 1*a* in FIG. 1A includes a plate-like substrate 10, and a polymer fiber assembly 11 formed on the substrate 10 and formed of polymer fibers 12. Meanwhile, a glossy member 1*b* in FIG. 1B includes the columnar (axial body-like) substrate 10, and the polymer fiber assembly 11 formed on the substrate 10, specifically on its outer peripheral surface and formed of the polymer fibers 12.

In the glossy member 1 of FIGS. 1A and 1B, the polymer fiber assembly 11 has at least the polymer fibers 12 that are ultrafine fibers. In addition, in the glossy member 1 of FIGS. 1A and 1B, the polymer fibers 12 are provided on the substrate 10 so as to be oriented in a uniaxial direction in the plane of the polymer fiber assembly 11. When the polymer fibers 12 are oriented in a given direction as described above, the polymer fiber assembly 11 becomes a dense film and the surface of the film becomes smooth. As a result, a glossy member having a satisfactory metallic gloss is obtained.

Next, constituent members for the glossy member of the present invention are described.

(1) Polymer Fiber Assembly (Nanofiber Film)

The polymer fiber assembly 11 in the glossy member of the present invention is a member having a metallic gloss and having the polymer fibers 12.

In the present invention, the polymer fibers 12 refer to fibers having at least one kind of polymer material and having lengths longer than their diameters. In the present invention, the fiber diameters of the polymer fibers 12 are 0.05 μm or more and 5 μm or less, and the lengths of the polymer fibers 12 are 10 times or more as long as the diameters. In particular, in the present invention, as the fiber diameters of the polymer fibers 12 in the polymer fiber assembly 11 having a metallic gloss become finer, the roughness of the surface unevenness of the assembly that may occur when the polymer fibers 12 are oriented reduces, and the fibers are closely packed, and hence a gapless and dense film is formed. Thus, the effect of the metallic gloss improves. Accordingly, in the present invention, the fiber diameters of the polymer fibers 12 are preferably 0.05 μm or more and 3 μm or less, more preferably 0.05 μm or more and 1 μm or less, particularly preferably 0.05 μm or more and less than 1 μm. Here, the case where the fiber diameters of the polymer fibers 12 are less than 1 μm is particularly preferred for obtaining a film having a metallic gloss because unevenness that may occur on the surface of the polymer fiber assembly when the polymer fibers 12 are oriented in a given direction becomes a submicron level or less. Meanwhile, when the fiber diameters of the polymer fibers 12 are set to 0.05 μm or more, excellent coatability is obtained because the polymer fiber assembly 11 constituted of the polymer fibers 12 can be easily formed on the surface of the plate-like substrate 10 or on the outer peripheral surface of the axial body-like substrate 10 well.

It is to be noted that the sectional shapes of the polymer fibers 12 in the polymer fiber assembly 11 are not particularly limited, and examples thereof include a circular shape, an elliptical shape, a quadrangular shape, a polygonal shape, and a semicircular shape. In addition, the sectional shapes of the polymer fibers 12 may not be accurate shapes, and shapes at arbitrary sections thereof may be different from each other. It is to be noted that in the present invention, in the case where the polymer fibers 12 are columnar, the fiber diameters of the polymer fibers 12 refer to the diameters of their sectional circular shapes, but in the other cases, the fiber diameters refer to the lengths of the longest straight lines passing the centers of gravity in the sections of the fibers.

In addition, in the glossy member 1 of FIGS. 1A and 1B, the polymer fiber assembly 11 is a film (laminate) formed by laminating two layers formed by arranging the polymer fibers 12 on the substrate 10 while orienting the fibers in a given direction. However, the number of the layers, which are formed by arranging the polymer fibers 12 while orienting the fibers in the given direction, in the polymer fiber assembly 11 is not particularly limited, and the number of the layers needs only to be appropriately determined in order that the glossy member 1 may be provided with desired characteristics. In addition, any other layer (such as an adhesion layer) may be disposed between the respective layers formed of the polymer fibers in the polymer fiber assembly 11. In addition, the surface of the polymer fiber assembly 11 may be subjected to a surface treatment with a clear coating or the like.

(2) Polymer Fibers (Polymer Nanofibers)

The polymer fibers 12 of the polymer fiber assembly 11 need only to contain at least one kind of conventionally known organic polymer material known to have the following characteristic: fibers whose fiber diameters are at nanolevels can be produced from the material by using an electrospinning method.

In addition, needless to say, any other component except the polymer material (organic polymer material) component may be incorporated into the polymer fibers 12 to the extent that the effects of the present invention are obtained. For example, a conventionally known inorganic filler may be incorporated into the polymer fibers 12 for improving the strength of the polymer fibers 12, or the strength of the polymer fibers 12 can be improved by appropriately using a conventionally known unit configured to bond the fibers.

It is to be noted that when the inorganic filler is incorporated into the polymer fibers 12, the addition amount of the inorganic filler is not particularly limited as long as desired physical properties are obtained for the polymer fibers 12, but the ratio of the inorganic filler to the amount of the polymer material is preferably as high as possible from the viewpoint of, for example, the improvement in strength. However, the content of the polymer material in the polymer fibers 12 is preferably 5 mass % or more and 80 mass % or less, more preferably 10 mass % or more and 60 mass % or less with respect to the entirety of the polymer fibers 12. That is, the incorporation of at least 5 mass % of the polymer material into the polymer fibers 12 can suppress their mechanical brittleness. It is to be noted that when the filler or the like is incorporated into the polymer fibers 12, the material to be incorporated into the polymer fibers 12 may be dispersed and mixed in the polymer material in advance with an ultrasonic wave or a ball mill.

In the present invention, the polymer fibers 12 have one or more polymer materials. The number of kinds of the polymer materials of the polymer fibers 12 may be one, or may be two or more. In the present invention, at least part of the repeating unit structure of the polymer material has a dipole moment of 0 D or more and 3.50 D or less, and an absolute value of a singly occupied molecular orbital (SOMO) of 9 eV or more and 12 eV or less. Thus, the polymer fiber assembly 11 in the glossy member 1 becomes a metallic glossy film that hardly deteriorates owing to oxidation even when used for a long time period, i.e., has high durability, which is preferred from the viewpoint of practical durability. It is to be noted that in the present invention, the term "repeating unit structure" refers to a monomer unit in the polymer material of the polymer fibers 12. In addition, in the present invention, the absolute value of the SOMO in the repeating unit structure is preferably 9 eV or more and 10 eV or less.

Here, when the dipole moment is 0 D or more and 3.50 D or less in at least part of the repeating unit structure in the polymer material of the polymer fibers 12, the polarity of the polymer material itself reduces and its wettability also reduces. Thus, the deterioration of the gloss due to, for example, the adhesion of dirt is suppressed. In addition, when the absolute value of the SOMO is 9 eV or more and 12 eV or less in at least part of the repeating unit structure in the polymer material, the radical stability of the polymer material itself improves and the polymer material becomes hard to deteriorate owing to oxidation. Thus, the deterioration of the gloss of the glossy member of the present invention due to, for example, the adhesion of dirt is suppressed even when the member is used for a long time period.

It is to be noted that when the polymer fibers 12 have two or more kinds of polymer materials, the requirements concerning the dipole moment and the SOMO need only to be satisfied in at least part of the repeating unit structure in at least one kind of polymer material out of these polymer materials. In addition, when at least one of the polymer materials of the polymer fibers 12 is a copolymer, the requirements concerning the dipole moment and the SOMO need only to be satisfied in at least one kind of two or more kinds of repeating unit structures in the copolymer.

It is to be noted that the following molecular orbital method calculation program is used in the calculation of the dipole moment and SOMO of the repeating unit structure in the polymer material.

Spartan'04 software for Windows version 1.0.3. (Wavefunction, Inc., Irvine, Calif., U.S.A.) (Windows is a trade name.)

Then, the dipole moment and the SOMO can be calculated by performing molecular orbital calculation based on Hartree-Fock approximation through the use of 6-31 G* as a basis function.

Specific examples of the polymer material having a repeating unit structure (monomer unit) having a dipole moment of 0 D or more and 3.50 D or less, and an absolute value of a SOMO of 9 eV or more and 12 eV or less include polymethyl methacrylate, polyethylene terephthalate, and a polyolefin. In the present invention, examples of the polymer materials can include a homopolymer and a copolymer, but a homopolymer is preferred. It is to be noted that values for the dipole moments and SOMO's of the repeating unit structures (monomer units) in those polymer materials are as shown in Table 1 below. Also shown in Table 1 for comparison is data on polyamide imide and polylactic acid.

TABLE 1

| Polymer material | Dipole moment [D] | SOMO [eV] |
|---|---|---|
| Polymethyl methacrylate | 1.47 | −9.56 |
| Polyethylene terephthalate | 3.31 | −9.23 |
| Polyolefin | 0.23 | −9.01 |
| Polyamide imide | 1.99 | −8.84 |
| Polylactic acid | 2.47 | −8.56 |

(3) Polymer Substrate

The polymer fiber assembly constituting the glossy member of the present invention and having a metallic gloss is laminated on the polymer substrate. In the present invention, examples of the polymer substrate include a plate- or rod-like polymer material and a thin film formed of a polymer material.

Here, in the present invention, a difference $\Delta\delta(A-B)$ between an average solubility parameter $\Delta_A$ of the polymer material of the polymer fibers in the polymer fiber assembly and an average solubility parameter $\delta_B$ of a constituent material (polymer material) for the polymer substrate satisfies a relationship represented by the following expression (1).

$$|\Delta\delta(A-B)|<5\ [(J/cm^3)^{1/2}] \quad (1)$$

When the expression (1) is satisfied, interfacial adhesiveness between the polymer fiber assembly and the polymer substrate improves, and hence a glossy member having satisfactory durability can be obtained.

It is to be noted that the average solubility parameter can be reworded as a SP value. In addition, the difference $\Delta\delta(A-B)$ between the average solubility parameter $\delta_A$ of the polymer material in the polymer fibers and the average solubility parameter $\delta_B$ of the constituent material for the polymer substrate can be reworded as a solubility parameter (SP) value difference.

A solubility parameter to be used in the present invention is a Hansen solubility parameter. The Hansen parameter is formed of energies formed of the dispersion force of an atom, a force produced between the permanent dipoles of molecules, and the hydrogen bond of the molecule, and the energies are represented by $\delta_D$, $\delta_P$, and $\delta_H$ $[(J/cm^3)^{1/2}]$, respectively. Here, the solubility parameter $\delta$ $[(J/cm^3)^{1/2}]$ of a substance satisfies a relationship represented by the following expression (2).

$$\delta=(\delta_D^2+\delta_P^2+\delta_H^2)^{1/2}\ [(J/cm^3)^{1/2}] \quad (2)$$

A method of obtaining the Hansen parameter is as follows: in the case of a general substance, a measured value is obtained from literature values, and even in the case of a special substance whose value is not obtained as a literature value, the value can be calculated with calculation software.

Incidentally, when substances whose Hansen parameters largely differ from each other are mixed, an energy required for these substances to mix (dissolve) increases and their solubilities reduce, and hence the mixing between the substances does not proceed. Here, a difference $|\Delta\delta(a-b)|$ $[(J/cm^3)^{1/2}]$ between the Hansen parameters of a substance a and a substance b can be calculated from the following expression (3).

$$|\Delta\delta(a-b)|=((\delta_{aD}-\delta_{bD})^2+(\delta_{aP}-\delta_{bP})^2+(\delta_{aH}-\delta_{bH})^2)^{1/2} \quad (3)$$

The solubility parameters $\delta$ [SP values, $(J/cm^3)^{1/2}$] of polymer material systems are as shown in, for example, Table 2 below.

TABLE 2

| Polymer material | SP value $[(J/cm^3)^{1/2}]$ |
|---|---|
| Polymethyl methacrylate | 9.5 |
| Polyethylene terephthalate | 10.7 |
| Polyolefin | 7.7 |
| Polyamide imide | 13.6 |
| Styrene-butadiene rubber | 8.1 |
| Polyvinyl alcohol | 12.6 |

Incidentally, the average solubility parameter of a polymer material is basically free from being affected by its molecular weight because the parameter is considered in terms of its unit. However, in the case of, for example, a polymer material in which a higher-order structure is formed, the molecular weight (weight-average molecular weight) of the polymer material is preferably from 2,000 to 200,000.

In the present invention, the constituent material for the polymer substrate and at least part of the polymer material of the polymer fibers are preferably the same material. This is because when at least part of the polymer material in the polymer fibers is the same material as the constituent material for the polymer substrate, a difference between the solubility parameters of the materials of the polymer substrate and the polymer fiber assembly can be reduced. In the present invention, the constituent material for the polymer substrate and the polymer material of the polymer fibers are more preferably the same material. This is because when the constituent material for the polymer substrate and the material of the polymer fibers are the same, the difference between the SP values of both the members can be set to zero.

(4) Orientation Degree of Polymer Fibers (Polymer Nanofibers)

When the polymer fibers to be used in the present invention are arrayed (oriented) in a given direction, the polymer fiber assembly containing the polymer fibers can be provided with a metallic gloss. Here, as long as physical properties required for a glossy member are obtained, the shape of the polymer fiber assembly obtained by orienting the polymer fibers may be simply a flat plate shape, or may be such a shape that the fibers are wound around the outer peripheral surface of an axial body-like substrate in the same direction without any gap. In addition, the nanofiber film can be produced by using an appropriately selected known technology, or in some cases, a combination of a plurality of known technologies. That is, for example, when the polymer fibers are aligned (oriented) in the same direction on the outer peripheral surface of the axial body-like substrate, the polymer fibers can be said to orient in the same direction on the axial body (e.g., a direction intersecting the axial direction of the axial body, preferably a direction perpendicular thereto). It is to be noted that in the present invention, the term "same direction (identical direction)" is a concept including a substantially same direction (substantially identical direction) including such deviation of the orientation direction of the polymer fibers from their target orientation direction that desired characteristics and effects are obtained.

The ratio at which the polymer fibers are arrayed in the same direction (uniaxially oriented) can be easily calculated as a polymer orientation degree (%) by the following method. That is, the polymer orientation degree can be calculated by: observing the glossy member of the present invention with a scanning electron microscope (SEM) or a laser microscope; and analyzing the resultant image (the image of the polymer fiber assembly in the glossy member) with the analysis command "Measure Direction Distribution" of image processing software (trade name: Azo-kun, manufactured by Asahi Kasei Engineering Corporation). More specifically, the tilt of a polymer fiber oriented in the target direction in the resultant image is defined as 0°, tilts relative to the polymer fiber ranging from 0° to 180° are divided into 18 equal sections in increments of 10°, each section is represented as a frequency, and the frequency distribution chart (histogram) of the numbers (frequencies) of fibers in the respective ranges (respective sections) observed is drawn. Thus, the orientation degree can be determined from the following expression (4).

$$\text{Orientation degree (\%)}=\text{Number of sections having frequencies equal to or less than half of maximum frequency/Number of all sections}\times 100 \quad (4)$$

It is to be noted that the orientation degree (%) in the expression (4) is the ratio at which the polymer fibers are arrayed (oriented) in one direction. That is, as the orientation degree becomes higher, the ratio at which the polymer fibers are arrayed (oriented) in one direction increases, in other words, higher orientation is achieved.

In the glossy member of the present invention, the orientation degree of the polymer fibers is 90% or more. Here, when the orientation degree is less than 90%, a metallic gloss may not be obtained. In the present invention, the orientation degree is preferably as high as possible, and specifically, the orientation degree is preferably 95% or more. When the orientation degree of the polymer fibers is set to 90% or more, the polymer fibers are aligned in a uniaxial direction in the plane of the polymer fiber assembly. In other words, with a construction in which the ultrafine fibers are arrayed in one direction, a dense film is formed, and as a result, a polymer fiber assembly having a satisfactory metallic gloss can be produced.

[Method of Producing Glossy Member]

The glossy member of the present invention having a metallic gloss is produced by forming the polymer fiber assembly on the substrate. Here, the polymer fiber assembly can be produced by a production method involving using an electrospinning method having an electric field-controlling unit configured to control the electric field of a spinning space ranging from a solution-leaving site to a collector.

Incidentally, Japanese Patent Application Laid-Open No. 2009-102778 discloses a method involving using an antistatic ion-irradiating unit, an airflow-controlling unit, or an electric field-controlling unit as a method of obtaining a polymer fiber assembly serving as a metallic glossy film. However, the units have involved problems in terms of practical use because a spinning apparatus construction for enabling a significantly high orientation degree is essential to each of the units. The problems are specifically as described below.

With regard to the antistatic ion-irradiating unit, an antistatic ion-irradiating space needs to be sufficiently secured in some cases in order that the removal of electricity in a spinning space may be satisfactorily performed, and hence a production apparatus necessarily becomes large.

With regard to the airflow-controlling unit, for example, a rotating collector mechanism that can rotate at a speed as high as 1,000 rpm or more needs to be disposed for controlling an airflow, and noise necessarily becomes loud.

The electric field-controlling unit configured to control the electric field of the spinning space is free of the problems occurring when the antistatic ion-irradiating unit and the airflow-controlling unit are used. However, Japanese Patent Application Laid-Open No. 2009-102778 discloses no specific approach to producing the unit.

The substrate (polymer substrate) to be used in a production method of the present invention is a member that can be appropriately prepared by a conventionally known method. In addition, the shape of the substrate is specifically, for example, a plate shape or an axial body shape, and the polymer fiber assembly is formed on the substrate. It is to be noted that the term "axial body" refers to a rod-like shape, and refers to, for example, a columnar rod or a prismatic rod.

Here, when the substrate is of an axial body shape, the mode of the substrate is specifically, for example, a resin material molded into an axial body shape, but is not limited thereto, and a product to be described below can also be used. That is, the product obtained by forming a surface layer formed of a resin on the periphery of a rod serving as a core by a known molding method, such as injection molding, extrusion molding, transfer molding, or press molding, can also be used as the substrate. It is to be noted that when the product obtained by forming the surface layer formed of the resin on the periphery of the core rod is used as the substrate, the surface layer of the substrate may be subjected to any one of a heating treatment and a polishing treatment as required.

An electrospinning method to be used in the present invention is one of the methods of producing polymer fibers. In the electrospinning method, various polymers can be easily spun into fiber shapes. In addition, when the electrospinning method is used, the shapes of the spun fibers can be controlled with relative ease, polymer fibers whose thickness is of the order of from several micrometers to nanometers can be easily obtained, and a production process becomes extremely simple. It is to be noted that the electrospinning method is a spinning method involving applying a high voltage between a syringe storing a raw material solution (polymer solution) for polymer fibers and a collector electrode to extrude the polymer solution serving as a raw material from the syringe, thereby providing the polymer fibers. In the electrospinning method, the raw material solution (polymer solution) extruded from the syringe is electrically charged to scatter in an electric field, but as a time elapses, a solvent in the scattered polymer solution evaporates to cause thinning. As a result, the polymer fibers are formed. The polymer fibers adhere to the collector.

It is to be noted that an approach to preparing the raw material solution to be used in the electrospinning method is not particularly limited, and a conventionally known method can be appropriately used. In addition, at this time, the kind of the solvent in the raw material solution and the concentration of a solute (polymer) in the solution are not particularly limited, and need only to be conditions optimum for the performance of the electrospinning method.

Figure 2:
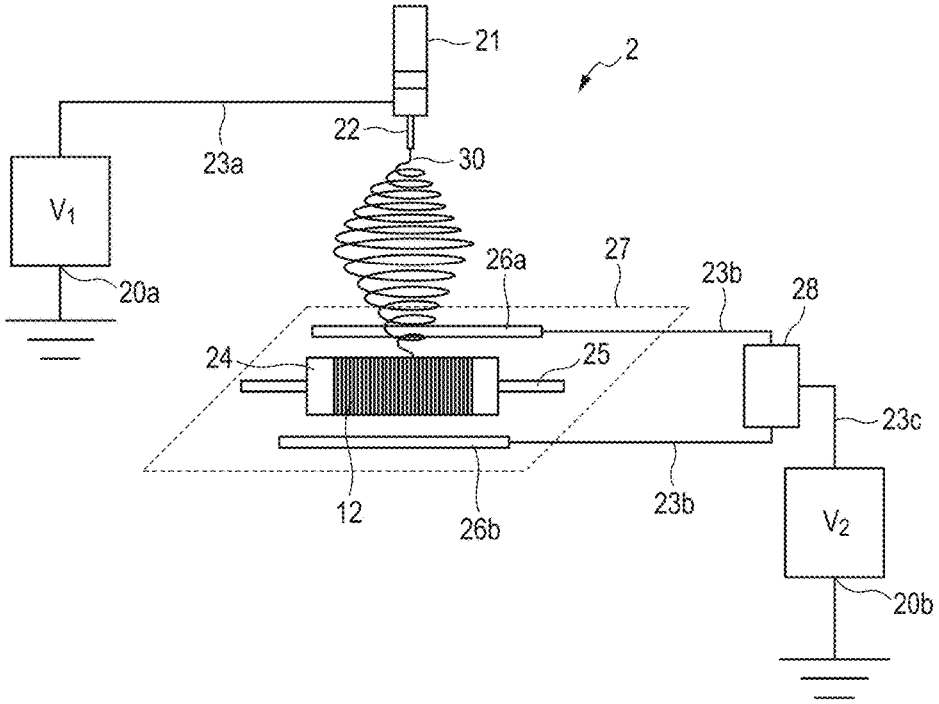
FIG. 2 is a schematic view for illustrating an example of an apparatus for forming a polymer fiber assembly in the glossy member.

The method of producing a glossy member of the present invention through the use of the electrospinning method is described below with reference to the drawings. FIG. 2 is a schematic view for illustrating an example of an apparatus for forming a polymer fiber assembly in the glossy member.

A forming apparatus 2 of FIG. 2 specifically adopts a method involving extruding a polymer solution stored in a storage tank 21 from a spinning nozzle 22 serving as a solution-leaving site. It is to be noted that in the forming apparatus 2 of FIG. 2, the storage tank 21 is electrically connected to a first high-voltage power source 20*a* through a wiring 23*a*. Thus, a voltage $V_1$ is applied from the first high-voltage power source 20*a* to the storage tank 21 and the spinning nozzle 22.

The polymer solution ejected from the spinning nozzle 22 becomes the polymer fibers 12 through the evaporation of a solvent in the solution, and the polymer fibers 12 are collected by an axial body-like (columnar) collector 24. In the forming apparatus 2 of FIG. 2, the axial body-like collector 24 is placed so as to be rotatable by an axis 25 connected to each of both of its end portions, and hence the polymer fibers 12 continuously formed by the electrospinning method can be wound around the outer peripheral surface of the axial body in the same direction without any gap.

In addition, a pair of two electrodes 26*a* and 26*b* placed to be spaced apart from the collector 24 and to sandwich the collector 24 therebetween is disposed in the forming apparatus 2 of FIG. 2. Here, the term "sandwich" refers to the following state: the collector 24 and the electrodes (26*a* and 26*b*) are present in an imaginary plane 27 in FIG. 2, and while the two electrodes (26*a* and 26*b*) are disposed with a given interval therebetween, the collector 24 is disposed in the midst of the interval.

In the forming apparatus 2 of FIG. 2, each of the two electrodes (26*a* and 26*b*) is connected to a voltage switching apparatus 28 by a wiring 23*b*. In addition, the voltage switching apparatus 28 is electrically connected to a second high-voltage power source 20*b* by a wiring 23*c*. Thus, a voltage $V_2$ is applied from the second high-voltage power source 20*b* to the two electrodes (26*a* and 26*b*), but is selectively applied to one of the two electrodes (26*a* and 26*b*) by the voltage switching apparatus 28. In addition, in the present invention, the voltage $V_2$ applied from the second high-voltage power source 20*b* is a voltage opposite to the voltage $V_1$ applied from the first high-voltage power source 20*a*, i.e., a voltage opposite in polarity thereto.

Here, an example of a method of producing a glossy member including a polymer fiber assembly through the use of the forming apparatus 2 of FIG. 2 is described.

First, a raw material solution containing at least a polymer component is prepared, and the raw material solution is introduced into the tank 21. Then, the raw material solution introduced into the tank 21 by a pump or the like (not shown) is extruded at a constant rate up to the spinning nozzle 22. The voltage $V_1$ of from 1 kV to 50 kV is typically applied to the spinning nozzle 22, and when electrical attraction produced between the spinning nozzle and the electrode (26*a* or 26*b*) exceeds the surface tension of the raw material solution, a jet 30 (ejected matter) of the raw material solution is injected toward the axial body-like collector 24. At this time, a solvent in the jet 30 gradually volatilizes, and when the jet reaches the collector 24, the size of the jet reduces to a nanolevel.

Here, during spinning, the voltage $V_2$ is applied from the second high-voltage power source 20*b* to the electrodes (26*a* and 26*b*), but is selectively applied to one of the two electrodes (26*a* and 26*b*) by the voltage switching apparatus 28. In addition, the electrode to which the voltage $V_2$ is applied can be switched by the voltage switching apparatus 28, and hence the voltage $V_2$ applied from the second high-voltage power source 20*b* is alternately applied to the two electrodes (26*a* and 26*b*). Then, the polymer fibers 12 are accumulated on the collector 24. Thus, a layer (film) formed of the polymer fibers 12 is formed on the collector 24. In addition, a product loaded into the tank 21 (storage tank) is not limited to the raw material solution (polymer solution), and may be a raw material in a molten state (molten polymer) obtained by heating a polymer material serving as a raw material for the polymer fibers 12 to a temperature equal to or more than its melting point.

Incidentally, when the voltage opposite to the voltage applied to the spinning nozzle (solution-leaving site) is applied to the electrodes (26*a* and 26*b*) sandwiching the collector 24, the jet 30 that has flown from the spinning nozzle 22 is attracted to the electrodes (26*a* and 26*b*). Here, the voltage $V_2$ is alternately applied to each of the electrodes (26*a* and 26*b*) at a predetermined switching speed, and hence the polymer fibers 12 are wound around the collector 24 while reciprocating in a direction vertical to the longitudinal direction (axial direction) of the collector 24 between the electrodes (26*a* and 26*b*). As a result, the polymer fibers 12 wound around the collector are oriented in the direction vertical to the longitudinal direction (axial direction) of the collector 24.

When the spinning of the polymer fibers 12 is performed with the forming apparatus 2 of FIG. 2, the magnitude of the voltage to be applied to the plurality of electrodes (26*a* and 26*b*) is not particularly limited as long as the polymer fibers 12 can be oriented in a desired direction. However, when the voltage ($V_2$) applied to the electrodes (26*a* and 26*b*) is excessively strong, the polymer fibers 12 may be accumulated on one of the electrodes (26*a* and 26*b*). On the other hand, when the voltage ($V_2$) applied to the electrodes (26*a* and 26*b*) is excessively weak, an effect on the orientation of the polymer fibers 12 exhibited by an electric field generated by applying the voltage to each of the electrodes (26*a* and 26*b*) while performing its switching may weaken. Accordingly, the voltage is preferably 50% or less of the absolute value of the voltage ($V_1$) applied to the spinning nozzle 22. In addition, when the voltage is alternately applied to each of the electrodes (26*a* and 26*b*), the time period for which the voltage is applied, i.e., a switching speed is not particularly limited as long as desired orientation is obtained for the polymer fibers 12, but the switching speed is specifically 1 second or less. When the switching speed is excessively slow as compared therewith, the orientation degree of the polymer fibers 12 reduces and the polymer fibers 12 are accumulated on one of the electrodes (26*a* and 26*b*) in some cases. On the other hand, the shortening of the switching speed tends to additionally increase the orientation degree of the polymer fibers 12.

Figure 3:
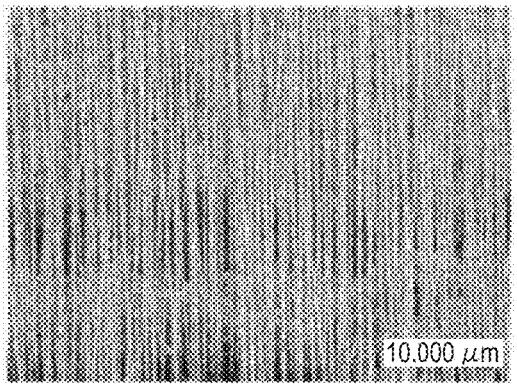
FIG. 3 is a laser microscope photograph for showing the polymer fiber assembly in the glossy member of the present invention.

FIG. 3 is a laser microscope photograph for showing the polymer fiber assembly in the glossy member of the present invention. It is to be noted that FIG. 3 is a photograph concerning such a polymer fiber assembly that a raw material for its polymer fibers is polymethyl methacrylate (PMMA).

When the glossy member of the present invention is produced, a method of forming the polymer fiber assembly on the substrate (including the outer peripheral surface of the axial body) is not particularly limited, and a technology appropriately selected from conventionally known technologies, or a combination of such technologies can be used. For example, a method involving producing such a film (polymer fiber assembly) that its polymer fibers are oriented in a uniaxial direction in advance, and then coating the substrate with the film may be used.

In addition, a conventionally known approach can be appropriately used for the lamination of the polymer fibers in the glossy member of the present invention; for example, the polymer fibers may be directly formed and laminated on the substrate, or after a layer formed of an adhesive (pressure-sensitive adhesive) has been disposed on the substrate, the polymer fibers may be laminated and bonded on the layer formed of the adhesive. In addition, when the substrate is of an axial body shape, an axial body formed of a central portion, a core rod, and a surface layer formed on the outer peripheral surface of the core rod may be used as the substrate. When the axial body is used, the polymer fibers may be formed and laminated on the surface of the surface layer after the surface of the surface layer has been subjected to a tackifying treatment. When the surface of the surface layer of the substrate is treated as described above, adhesiveness between the substrate and the polymer fibers can be easily improved, and hence excellent durability is obtained. In addition, at least the surface of the polymer substrate in the glossy member of the present invention is a resin, and hence the polymer material serving as a raw material for the polymer fibers is preferably a material having high adhesiveness with the resin. The use of the polymer material having high adhesiveness with the resin can facilitate the lamination and bonding of the polymer fibers on the substrate without the use of any adhesive (pressure-sensitive adhesive) or the like. To this end, for example, a polymer whose SP value difference from a material for the substrate is considered as described above can be used as the polymer material to be used for the formation of the polymer fibers.

In the present invention, the polymer fiber assembly in the glossy member may be formed of one kind of polymer material, or may be formed of a polymer blend prepared by mixing two or more kinds of polymer materials.

EXAMPLES

The present invention is described in detail below by way of Examples. It is to be noted that Examples to be described below are merely illustrative and do not limit the scope of the present invention. Various modifications and alterations of Examples to be described below are also included in the present invention.

Example 1

In Example 1, a glossy member in which a film formed of polymer fibers was disposed on the outer periphery of a rod-like substrate (polymer substrate) formed of a polymer material was produced. It is to be noted that the film is a polymer fiber assembly disposed on the polymer substrate.

(1) Preparation of Polymer Solution

First, polymethyl methacrylate (PMMA, manufactured by Sumitomo Chemical Co., Ltd.) and dimethylformamide (DMF) were mixed to prepare a polymethyl methacrylate solution (paste diluted solution) having a solute concentration of 28 wt %.

(2) Apparatus for Producing Glossy Member

In this example, the polymer fibers formed by an electrospinning method were directly wound around the rod-like polymer substrate (commercially available PMMA acrylic round rod). Thus, the glossy member including the polymer fiber assembly was produced.

In this example, the apparatus of FIG. 2 was used as an apparatus for producing the glossy member. Here, an electrospinning apparatus (manufactured by MECC Co., Ltd.) was used as the polymer solution-ejecting portion 22. In addition, a φ10 PMMA acrylic round rod was used as the collector 24 (rotating collector). In addition, two rod-like metal electrodes (the electrodes 26*a* and 26*b*) placed to be spaced apart from the collector 24 (φ10 PMMA acrylic round rod) and to sandwich the collector 24 therebetween were disposed as an electric field-controlling unit configured to control the electric field of a spinning space ranging from the injection orifice 22 (solution-leaving site) to the collector 24. In addition, the two rod-like metal electrodes (26*a* and 26*b*) were connected to a switching electrode unit (the voltage switching apparatus 28, manufactured by MECC Co., Ltd.), which was connected to the second high-voltage power source 20*b*, so that the voltage $V_2$ opposite to the voltage applied to the solution-leaving site could be alternately applied to the two rod-like metal electrodes (26*a* and 26*b*) while being switched.

(3) Spinning Step

Spinning was performed as described below. That is, the paste diluted solution obtained in the section (1) was loaded into the tank 21. Then, while a voltage of 18 kV was applied to the spinning nozzle 22, the nozzle was reciprocated in the longitudinal direction of the collector (direction parallel to the axis of the collector 24) at 50 mm/s. The voltage $V_2$ was applied to the two rod-like metal electrodes (26*a* and 26*b*) simultaneously with the application of the voltage $V_1$ to the spinning nozzle 22. Specifically, a voltage of −4.5 kV was applied to one of the two rod-like metal electrodes (26*a* and 26*b*) while being switched at a switching speed of 0.5 second. The jet 30 of the paste diluted solution was injected from the spinning nozzle 22 toward the collector 24 by the application of the voltages described above. It is to be noted that in this example, the paste diluted solution was injected for 50 minutes.

(4) Winding Step

The polymer fibers obtained by the injection of the paste diluted solution were wound around the collector (rotating collector) rotating in the same direction at a speed as low as 50 rpm. Thus, a film (the polymer fiber assembly 11) in which the outer peripheral surface of the axial body-like substrate 10 (PMMA acrylic rod) was coated with the polymer fibers 12 in a direction substantially perpendicular to its axial direction so that the layer of the fibers had a thickness of 10 μm was able to be easily obtained. The resultant film was a metallic glossy fiber film showing a silver color. It is to be noted that the thickness of the polymer fibers 12 formed on the substrate (average of the fiber diameters of the polymer fibers) was 800 nm, and each of the orientation degrees of the polymer fiber assembly 11 formed on the axial body-like substrate 10 measured at arbitrary points was 95%.

Example 2

In the section (1) of Example 1, a material obtained by mixing polyethylene terephthalate (PET, manufactured by Mitsui Chemicals, Inc.) and polymethyl methacrylate (PMMA) at a volume ratio of 6:4 was used as the solute instead of the polymethyl methacrylate. A glossy member was produced by the same method as that of Example 1 except the foregoing. In this example as well, a film (polymer fiber assembly) that had polymer fibers oriented in a direction substantially perpendicular to the axial direction of the axial body-like polymer substrate 10 (commercially available PMMA acrylic round rod), and had a thickness of 10 μm was able to be easily formed on the outer peripheral surface of the substrate. The resultant film was a metallic glossy film showing a silver color. It is to be noted that the thickness (average polymer fiber diameter) of the polymer fibers 12 in the resultant glossy member was 600 nm, and each of the orientation degrees of the polymer fiber assembly 11 formed on the axial body-like substrate 10 measured at arbitrary points was 95%.

Example 3

In the section (1) of Example 1, a polyolefin (manufactured by Zeon Corporation) was used as the solute instead of the polymethyl methacrylate. In addition, in the section (2) of Example 1, a product obtained by coating the surface of an axial body (φ10 PMMA acrylic round rod) with an epoxy resin (manufactured by DIC Corporation) so that the resin had a thickness of about 1 μm was used as the polymer substrate. A glossy member was produced by the same method as that of Example 1 except the foregoing. In this example as well, a film (polymer fiber assembly) that had polymer fibers oriented in a direction substantially perpendicular to the axial direction of the axial body-like polymer substrate, and had a thickness of 10 μm was able to be easily formed on the outer peripheral surface of the substrate. The resultant film was a metallic glossy film showing a silver color. It is to be noted that the thickness (average polymer fiber diameter) of the polymer fibers 12 in the resultant glossy member was 750 nm, and each of the orientation degrees of the polymer fibers 12 formed on the axial body-like substrate 10 measured at arbitrary points was 93%.

Comparative Example 1

A glossy member was produced by the same method as that of Example 1 with the exception that in the section (2) of Example 1, while a flat plate connected to the ground was used as the collector instead of the rotating collector, the two rod-like metal electrodes were not used.

In this comparative example, a film having polymer fibers and having a thickness of about 30 μm was able to be easily obtained on the collector (flat plate). However, the resultant film did not show any metallic gloss and was white. It is to be noted that the thickness (average polymer fiber diameter) of the polymer fibers in the resultant film was 750 nm, and each of the orientation degrees of the polymer fibers formed on the collector measured at arbitrary points was 0%.

Comparative Example 2

A glossy member was produced by the same method as that of Example 1 with the exception that in the section (3) of Example 1, the voltage applied to the spinning nozzle was set to 22 kV, the voltage applied to the two rod-like metal electrodes was set to −1.0 kV, and the switching speed of the application of the voltage to each of the rod-like metal electrodes was set to 5 seconds.

In this comparative example, a film (polymer fiber assembly) formed of polymer fibers and having a thickness of about 10 μm was able to be easily obtained on the outer peripheral surface of the axial body-like substrate. However, the resultant film did not show any metallic gloss and was white. It is to be noted that the thickness (average polymer fiber diameter) of the polymer fibers in the resultant glossy member was 800 nm, and each of the orientation degrees of the polymer fibers formed on the axial body-like substrate measured at arbitrary points was 85%.

Comparative Example 3

In the section (1) of Example 1, polyamide imide (PAI, manufactured by Toyobo Co., Ltd.) was used as the solute instead of the polymethyl methacrylate. In addition, in the section (2) of Example 1, a product obtained by coating the surface of an axial body (φ10 PMMA acrylic round rod) with a styrene-butadiene rubber sheet (SBR, manufactured by Zeon Corporation) sliced so as to have a thickness of about 1 μm was used as the polymer substrate. A glossy member was produced by the same method as that of Example 1 except the foregoing.

In this comparative example, a film (polymer fiber assembly) having polymer fibers and having a thickness of about 10 μm was able to be easily formed on the outer peripheral surface of the axial body-like substrate. However, the resultant film did not show any metallic gloss and was white. It is to be noted that the thickness (average polymer fiber diameter) of the polymer fibers in the resultant glossy member was 800 nm, and each of the orientation degrees of the polymer fibers formed on the axial body-like substrate measured at arbitrary points was 85%.

Comparative Example 4

In the section (1) of Example 1, polylactic acid (PLLA, manufactured by Polysciences, Inc.) was used as the solute instead of the polymethyl methacrylate. In addition, in the section (2) of Example 1, a round rod (φ10) produced by cutting a polytetrafluoroethylene (PTFE) resin was used as the axial body-like polymer substrate. A fiber film was produced in the same manner as in Example 1 except the foregoing.

In this comparative example, a film (polymer fiber assembly) formed of polymer fibers and having a thickness of about 10 μm was able to be easily obtained on the outer peripheral surface of the axial body-like substrate. In addition, the resultant film showed a silver metallic gloss. It is to be noted that the thickness (average polymer fiber diameter) of the polymer fibers in the resultant glossy member was 630 nm, and each of the orientation degrees of the polymer fibers formed on the axial body-like substrate measured at arbitrary points was 95%.

[Evaluations of Glossy Member]

The produced glossy members were subjected to evaluations to be described below.

(1) Evaluation for Contamination Durability (Dirt Adhesion Ratio)

An evaluation for contamination durability was performed by performing the following simple test.

First, a resultant glossy member was irradiated with UV light under high humidity (70%) for 1 week. After that, the following dirt adhesion test was performed and a dirt adhesion ratio was calculated as described below.

In other words, 1 g of a powdery contaminant (polystyrene particles, size: 5 μm) was applied onto a test piece (measuring 2 cm by 0.5 cm) produced by cutting part of the polymer fiber assembly in the resultant glossy member. Next, excess contamination was removed by shaking the test piece 20 times with its applied surface inverted while irradiating the test piece with UV light from an ionizer, and then the number of dirts in a CCD camera image was counted (contamination A). After that, a predetermined surface of the substrate constituting the glossy member on which the polymer fiber assembly was not formed was flipped with a finger 10 times, and the number of dirts in a CCD camera image was counted again (contamination B).

In addition, the dirt adhesion ratio was calculated from the following equation (I). It is to be noted that the term "average" in the equation (I) refers to an average obtained by averaging measured values obtained by performing the measurement 5 times.

$$[\text{Average of (contamination } B)]/[\text{average of (contamination } A)]=(\text{dirt adhesion ratio}) \quad \text{(I)}$$

The evaluation for contamination durability was performed by checking the dirt adhesion ratio obtained as a result of the calculation against the following evaluation criteria.

○: The dirt adhesion ratio is 10% or less.

x: The dirt adhesion ratio is more than 10%.

(2) Presence or Absence of Metallic Gloss

The glossy members were visually evaluated for their metallic glosses while being compared with a metal plate, such as an aluminum plate.

(3) Interfacial Peeling Resistance Test

The polymer fiber assembly in a produced glossy member can be evaluated for its adhesiveness with the substrate by an interfacial peeling resistance test. The interfacial peeling resistance test can be performed in accordance with, for example, a process to be described below.

While the glossy member serving as a bending object was warmed at 60° C., the glossy member was bent until an angle among a bent portion, an axis serving as the center of bending, and the original position became 30°, provided that a state immediately after the initiation of the bending where the polymer fiber assembly of the glossy member was of a flat shape was defined as a bending angle of 0°. After that, the glossy member was bent until the bending angle passed 0° and became −30°, and the bending angle was returned to 0°. The series of operations was defined as 1 set, and the set was repeated 20 times. After that, interfaces between the polymer fiber assembly and the substrate before and after the bending test were observed with a laser microscope, and the evaluation was performed by using the following evaluation criteria.

○: Peeling at the interface of the polymer fiber assembly does not occur in 20 arbitrary measurement regions, or occurs to an extremely slight extent, and hence no problems occur in practical use.

x: Peeling at the interface of the polymer fiber assembly occurs in 20 arbitrary measurement regions, and the occurrence is observed in most or entirety of the measurement regions.

The results of the evaluations of the glossy members in Examples and Comparative Examples are shown in Table 3 below.

TABLE 3

| | Polymer material | Thickness of polymer fibers [nm] | Orientation degree (%) | Metallic gloss (tint) | Contamination durability (dirt adhesion ratio) | Substrate (SP value difference)(note) | Interfacial peeling resistance test |
|---|---|---|---|---|---|---|---|
| Example 1 | PMMA | 800 | 95 | Present (silver) | ○ (1%) | PMMA (0) | — |
| Example 2 | PET/PMMA (6/4) | 600 | 95 | Present (silver) | ○ (3%) | PMMA (<1.2) | — |
| Example 3 | Polyolefin | 750 | 93 | Present (silver) | ○ (3%) | Epoxy (3.2) | ○ |
| Comparative Example 1 | PMMA | 750 | 0 | Absent (white) | — | — | — |
| Comparative Example 2 | PMMA | 800 | 85 | Absent (white) | — | — | — |
| Comparative Example 3 | PAI | 800 | 85 | Absent (white) | x (12%) | SBR (5.5) | x |
| Comparative Example 4 | PLLA | 630 | 95 | Present (silver) | x (10%) | PTFE (5.2) | x |

(note)A SP value difference between a polymer substrate and a polymer material in polymer fibers As can be seen from Table 3, the glossy members obtained in Examples 1 to 3 showed silver metallic glosses because the glossy members had films (polymer fiber assemblies) obtained by orienting ultrafine fibers (polymer fibers) in predetermined directions. Accordingly, it was able to be confirmed that a glossy member having a metallic gloss was obtained by forming a polymer fiber assembly on a substrate in accordance with the production method of the present invention.

In addition, the polymer fiber assemblies in the glossy members of Examples 1 to 3 are formed of polymer fibers formed of an organic polymer, such as the PMMA, the PET, or the polyolefin. Those polymer fibers are formed of a repeating unit structure having a dipole moment of 0 D or more and 3.50 D or less, and an absolute value of a SOMO of 9 eV or more and 12 eV or less. As can be seen from Table 3, the glossy members obtained in Examples 1 to 3 had satisfactory contamination durabilities (dirt adhesion ratios). On the other hand, the contamination durability (dirt adhesion ratio) of the glossy member of Comparative Example 3 including the polymer fiber assembly formed of the polymer fibers formed of the PAI was not as satisfactory as those of the glossy members of Examples 1 to 3. It was able to be confirmed from the foregoing that when at least part of polymer fibers in a glossy member were a repeating unit structure having a dipole moment of 0 D or more and 3.50 D or less, and an absolute value of a SOMO of 9 eV or more and 12 eV or less, the deterioration of its gloss due to, for example, the adhesion of dirt was suppressed.

It was able to be confirmed from the result of Comparative Example 4 that even when a glossy member showed a metallic gloss, in the case where its SP value difference ($|\Delta\delta(A-B)|$) was 5 $[(J/cm^3)^{1/2}]$ or more, the result of the contamination durability test was poor. Accordingly, it was able to be confirmed that in a system like Comparative Example 4, the gloss of a glossy member deteriorated owing to, for example, the adhesion of dirt.

In addition, it was able to be confirmed from Examples 1 to 3, and Comparative Example 3 and Comparative Example 4 that when a SP value difference ($|\Delta\delta(A-B)|$) between a substrate (polymer substrate) and a polymer material in polymer fibers was less than 5 $[(J/cm^3)^{1/2}]$, a glossy member having satisfactory interfacial peeling resistance was obtained.

As can be seen from Table 3, the orientation degrees of the polymer fibers in the glossy members of Examples 1 to 3 and Comparative Example 4 were 90% or more. On the other hand, the members produced in Comparative Examples 1 to 3 did not show a metallic gloss provided by the orientation of polymer fibers in one predetermined direction, and were white. Here, the orientation degrees of the films formed of the polymer fibers (polymer fiber assemblies) in the members of Comparative Examples 1 to 3 fell within the range of from 0% to 85%. Accordingly, it was able to be confirmed that such an ultrafine fiber film (polymer fiber assembly) that the orientation degree of its polymer fibers was 90% or more was extremely effective in obtaining a metallic glossy film.

It is to be noted that it was able to be confirmed that in Comparative Example 3, the orientation degree was poor and the fibers were not aligned without any gap, and hence dirt engaged with a mesh to deteriorate the contamination durability.

As described above, according to the present invention, a glossy member including a metallic glossy film (polymer fiber assembly) formed of ultrafine polymer fibers arrayed in one direction by an electric field-controlling unit, and a method of producing the member were able to be provided.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-018344, filed Feb. 2, 2015, which is hereby incorporated by reference herein in its entirety.

What is claimed is:

1. A glossy member, comprising:

a polymer substrate; and a polymer fiber assembly disposed on the polymer substrate, wherein:

the polymer fiber assembly consists of polymer fibers having fiber diameters of 0.05 μm to less than 1 μm and forming a film shape;

the polymer fibers are in contact with each other and are oriented in a given direction such that the polymer fibers have an orientation degree of at least 90%;

an absolute value of a difference between an average solubility parameter of a constituent material for the polymer substrate and an average solubility parameter of a polymer material of the polymer fibers is less than 5 $(J/cm^3)^{1/2}$; and each of the polymer fibers contains a polymer material having a repeating unit, which has a dipole moment of 0 D to 3.50 D, and an absolute value of a SOMO of 9 eV to 12 eV.

2. The glossy member according to claim 1, wherein the orientation degree of the polymer fibers is 95% or more.

3. The glossy member according to claim 1, wherein the constituent material for the polymer substrate and at least part of the polymer material comprise the same material.

4. The glossy member according to claim 1, wherein the absolute value of the SOMO is 9 eV to 10 eV.

5. The glossy member according to claim 1, wherein:

the orientation degree of the polymer fibers is 95% or more; and the constituent material for the polymer substrate and the polymer material comprise the same material.

6. The glossy member according to claim 1, wherein the polymer material comprises a homopolymer.

7. The glossy member according to claim 1, wherein the polymer fiber assembly has a metallic gloss.

8. The glossy member according to claim 1, wherein the polymer fibers of the polymer fiber assembly are packed so as to form a gapless dense film.

* * * * *